US005652405A

United States Patent [19]

Rakov

[11] Patent Number: 5,652,405

[45] Date of Patent: Jul. 29, 1997

[54] SYSTEM FOR SHOOTING USING COMPRESSED GAS

[76] Inventor: Mikhail A. Rakov, 1028 Marcussen Dr., Menlo Park, Calif. 94025

[21] Appl. No.: 658,183

[22] Filed: Jun. 4, 1996

[51] Int. Cl.[6] ..... F41F 1/00

[52] U.S. Cl. ..... 89/7; 89/1.34; 102/440; 124/57

[58] Field of Search ..... 89/7, 1.34; 102/440; 124/57, 76, 77, 71, 73

[56] References Cited

U.S. PATENT DOCUMENTS

| | | | |
|---|---|---|---|
| 279,539 | 6/1883 | Chamberlain | 124/57 |
| 2,375,314 | 5/1945 | Mills | 124/57 |
| 2,588,184 | 3/1952 | Walsh | 124/57 |
| 3,102,525 | 9/1963 | Englis | 124/57 |
| 3,175,494 | 3/1965 | Turner | 102/440 |
| 3,369,609 | 2/1968 | Fogelgrer | 124/57 |
| 3,417,719 | 12/1968 | Nitenson | 124/57 |
| 4,328,632 | 5/1982 | Beers | 102/440 |
| 4,776,255 | 10/1988 | Smith | 89/1.34 |
| 4,843,750 | 7/1989 | Blase | 102/442 |

FOREIGN PATENT DOCUMENTS

| | | | |
|---|---|---|---|
| 2034994 | 1/1972 | Germany | 124/57 |

*Primary Examiner*—Stephen M. Johnson
*Attorney, Agent, or Firm*—Edward B. Weller; Oblon, Spivak, McClelland, Maier & Neustadt, P.C.

[57] ABSTRACT

A shooting system discharges a projectile having a chamber that stores a compressible fluid in a compressed state and having a valve mounted in a rear end of the projectile. The shooting system includes a longitudinal barrel having an opening on a front end and having a cap on a rear end. The projectile is movable within the barrel. The rear end of the projectile, the barrel, and the cap form a chamber. A striker is disposed in the cap for opening the valve of the projectile to release the fluid into the chamber to urge the projectile toward the opening of the barrel as the fluid is released. The projectile forms a hermetic seal between the projectile and the barrel to substantially contain the released fluid in the chamber until the projectile exits the opening of the barrel. A stabilizer, such as fins, may be detachably mounted to the opening of the barrel so that the projectile contacts the stabilizer and urges the stabilizer into flight to stabilize the discharged projectile. A useful load may be detachably mounted to the front end of the barrel. In another embodiment, the barrel may include a flexible inner tube disposed along an inner wall of the barrel engaging the projectile to form the chamber. The inner tube expands to engage the inner wall of the barrel during the release of the fluid. In yet another embodiment, the barrel may include a semi-rigid portion and a flexible portion. The flexible portion has a first end mounted to a front end of the semi-rigid portion and has a second end for engaging the projectile near an end of the projectile adjacent the valve and for forming a hermetic seal. The flexible portion of the barrel is insertable into the barrel to position the valve near the striker. The hermetic seal substantially contains the released fluid in the chamber until the projectile exits the opening of the barrel, and extends and disengages from the flexible portion.

6 Claims, 5 Drawing Sheets

SYSTEM FOR SHOOTING USING COMPRESSED GAS

FIELD OF THE INVENTION

The present invention relates to accelerating objects using compressed gas, particularly gas contained in a cartridge comprising a thick-wall body and a membrane that are widely used in different areas of industry and house economy. This process of accelerating the objects can be broadly defined as a "shooting" and can be used for delivering objects in an emergency situation, extracting parachutes, and the like, as well as in real shooting.

BACKGROUND OF THE INVENTION

Some shooting systems use a compressed gas, such as carbon dioxide, stored in a cartridge. In such systems, the compressed gas is released to provide the energy source for acceleration of a separate projectile, such as a bullet, a pellet or the like. These shooting systems are rather complicated mechanically; they require high precision machining and molding for valves, pipes, mechanical parts, and projectiles. In addition, the material contained in the cartridge is not used in the process of shooting and is discarded after exhausting the gas contained in cartridge. A new approach to the method and devices for shooting using compressed gas is desired.

SUMMARY OF THE INVENTION

In the present invention, a cartridge containing a compressed gas is used both as a source of energy and as a projectile. The cartridge includes a valve on one end of the cartridge. The valve may be, for example, a membrane. The cartridge may include an annular wad that is disposed on an outer surface of the cartridge and towards the membrane. The cartridge is inserted into the barrel and the membrane is opened by piercing it with a striker, to thereby expire gas. The pressure of the expiring gas forces the cartridge together with the wad to move forward until reaching the end of the barrel. After exiting the barrel, further movement of the cartridge as a projectile continues by the force of inertia.

The present provides a method for shooting a projectile that stores a compressible fluid in a compressed state and has a valve mounted in a rear end of the projectile. A projectile is oriented in a barrel with the valve positioned near a striker mounted to the end of the barrel. The valve of the projectile is opened. A chamber formed by the barrel and the projectile is pressurized by releasing the compressible fluid from the projectile.

A hermetic seal is formed between the projectile and the barrel. The hermetic seal may be achieved by an annular wad or in other ways described below. The opening may include urging the striker to open the valve. The valve of the projectile may be a membrane, and the urging the striker step includes piercing the membrane.

A shooting system shoots a projectile, which stores a compressible fluid in a compressed state and has a valve mounted in a rear end of the projectile. A longitudinal barrel has an opening on a front end and has a cap on a rear end. The projectile is movable within the barrel. A striker is disposed in the cap for opening the valve of the projectile to release said fluid into a chamber to urge the projectile toward the opening of the barrel as the fluid is released. The rear end of the projectile, the barrel, and the cap form the chamber.

The projectile forms a hermetic seal between the projectile and the barrel to substantially contain the released fluid in the chamber until the projectile exits the opening of the barrel. The barrel and the striker may be formed of a disposable material. The flight of the projectile may be stabilized. An inner surface the barrel may be rifled. A load may be detachably mounted to the front end of the barrel and may include a plurality of stabilizers.

In another embodiment, the barrel comprises a flexible inner tube disposed along an inner wall of the barrel. The projectile engages the end of the flexible inner tube that is nearest the rear end of the barrel. The inner tube, the barrel, and the projectile form the chamber that is pressurized during the release of the fluid from the projectile. The inner tube expands to engage the inner wall of the barrel during the release of the fluid.

In yet another embodiment, the barrel comprises a semi-rigid portion and a flexible portion. The flexible portion has a first end mounted to a front end of the semi-rigid portion and has a second end for engaging the projectile near an end of the projectile adjacent the valve. The flexible portion of the barrel is capable of being inserted into the barrel to position the valve of the projectile near the striker. The projectile forms a hermetic seal between the projectile and the second end of the flexible portion of the barrel to substantially contain the released fluid in the chamber until the projectile exits the opening of the barrel, and extends and disengages from the flexible portion.

The method of shooting and the shooting system allow the projectile to be moved more simply with less moving parts and without high precision parts.

DETAILED DESCRIPTION OF THE PREFERRED EMBODIMENTS

Figure 1:
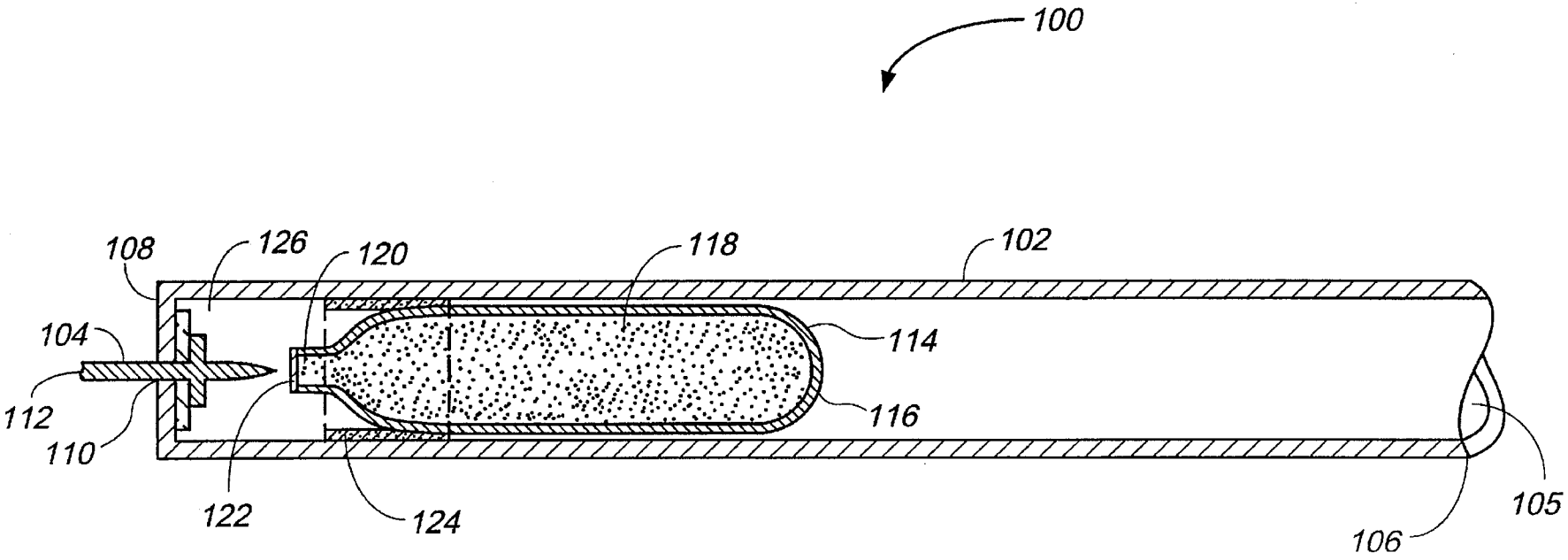
FIG. 1 is a longitudinal cross sectional view illustrating a shooting system in accordance with the present invention.

Referring to the FIG. 1 there is shown a longitudinal cross-sectional view illustrating a shooting system 100, which includes a barrel 102 and a striker 104. The barrel 102 has a constant uniform transverse cross-section, which is preferably circular. The barrel 102 includes a bore 105 disposed along a longitudinal axis of the barrel 102. A front end of the bore 105 forms an opening 106. The barrel 102 includes an end cap 108 on a rear end of the bore 105. The end cap 108 hermetically seals the rear end of the barrel 102. The barrel 102 is formed of a rigid material such as aluminum or a rigid plastic.

The striker 104 is disposed through a hole 110 in the end cap 108. A hermetic seal around the hole 110 in the end cap 108 prevents gases from passing through the hole 110. A rear end 112 of the striker 104 which is external to the barrel 102 couples to a trigger mechanism (not shown). The trigger mechanism preferably includes a spring to ret-urn the striker 104 to an initial position after being urged into the barrel 102. For simplicity, the trigger mechanism for actuating the striker 104 is not shown. The shooting system 100 may be mounted to a stock, as in a conventional rifle, or to a pistol grip. The striker 104 may be coupled to a conventional trigger. Alternatively, a finger grip may be coupled to the rear end of the barrel 102 so that when the user holds the shooting system 100 the striker 118 Engages the palm of the hand. The user curls his fingers to urge the striker 104 into the palm of the hand to discharge a projectile 114 positioned in the barrel 102.

The projectile 114 includes a housing 116 having a fluid containment chamber 118 therein with an opening 120 on a rear end of the housing 116. A valve 122 is mounted across the opening 120 of the projectile 114. The valve 122 may be, for example, a thin membrane. The fluid containment chamber 118 stores a compressible fluid in a compressed state. The fluid may be, for example, carbon dioxide. The projectile 114 releases the fluid when the valve 122 is opened. For a valve 122 that is a membrane, the membrane typically is pierced to release the fluid.

The projectile 114 includes an annular wad 124 disposed on the outer surface of the housing 116. When the projectile 114 is in the barrel 102, the wad 124 engages both the barrel 102 and the projectile 114 to form a chamber 126 between the barrel 102, the end cap 108, and the projectile 114. The wad 124 forms a hermetic seal to substantially prevent the flow of gas from the chamber 126 through a windage between the inner surface of the barrel 102 and the projectile 114.

The wad 124 can be integral with the housing 116. The wad 124 provides hermetization between the projectile 114 and the barrel 102. In an embodiment in which the outer diameter of the projectile 114 closely matches the inner diameter of the bore 105, the projectile 114 need not include the wad 124. In such an embodiment, the cartridge itself provides a simplified projectile.

Figure 2:
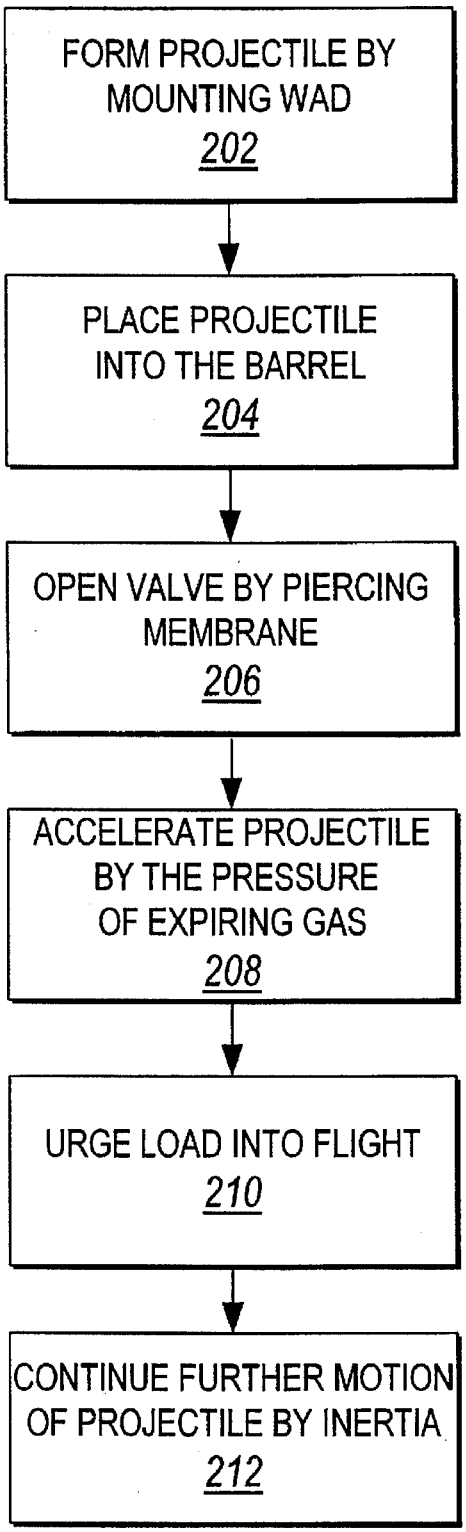
FIG. 2 is a flowchart illustrating the sequence of operations in the proposed method.

Referring to the FIG. 2, there is shown a flowchart illustrating the sequence of operations of the method of shooting in accordance with the present invention. The projectile 114 is formed 202 by mounting the wad 124 on the outer surface of the housing 116. Of course, in some embodiments such as described below in conjunction with FIGS. 3–7, the forming 202 may be skipped. The projectile 114 is placed 204 into the bore 105 of the barrel 102 with the valve end of the projectile 114 being positioned adjacent the striker 104. The shooting system 100 is now initialized for firing.

The striker 104 is actuated and urged into contact with the valve 122 of the projectile 114 to open 206 the valve. For a valve 122 that is a membrane, the striker 104 pierces the membrane and then withdraws from the hole in the membrane to thereby release the compressed gas. The gas exhausts from the fluid containment chamber 118 of the projectile 114 into the chamber 126 and fills the chamber 126 to thereby pressurize the chamber 126.

The pressure P of this gas interacts with the projectile 114 to produce a linear force F which is proportional to the pressure P and the area S of the back end of the projectile 114:

$$F=P\times S \tag{1}$$

The parameters of the expiring gas obey to the law of Charles and Gay-Lussac:

$$P\times V=nRT \tag{2}$$

where P is the pressure of the gas in the chamber 126, V is the volume of the chamber 126, n is the number of moles of the gas, and R is a constant for a specific gas.

As the gas discharges into the chamber 126, the force from the pressurized gas in the chamber 126 accelerates 208 the projectile 114 in accordance with Newton's second law of motion:

$$a=k\times F/m \tag{3}$$

where a is the acceleration of the projectile, F is the force acting on the projectile 114, m is the mass of the projectile 114, and k is a proportionality constant, which depends on the units selected for the acceleration a, the force F, and the mass m.

At the front end of the barrel 102, the projectile 114 has an exit velocity v defined by the equation:

$$v=a\times t, \tag{4}$$

where t is the time of exhausting the compressed gas from the projectile 114. The projectile 114 may engage a useful load, described below, and urge 210 such load into flight. After exiting the barrel 102, further motion 212 of the projectile 114 is due to the law of inertia. This description of the process is somewhat simplified. Of course, the pressure varies in time and the velocity is a time integral of the acceleration of equation (3) using equations (1) and (2) to define the force F acting on the projectile 114 from the pressurized gas. However, the velocity defined by equation (4) may provide satisfactory qualitative as well as quantitative results.

The method and system of the present invention provides simpler shooting than conventional air guns. The shooting system 100 does not require gas pipes or high precision parts. The only moving part is the striker 104. The projectile 114 and the barrel 102 form a hermetic seal. In contrast, conventional compressed gas shooting systems require higher precision parts.

The gas-containing cartridge itself is used as a projectile, so its material is not wasted. The shooting system 100 does not require special high-precision bullets, pellets, or the like. The projectile 114 may be, for example, inexpensive conventional compressed gas cartridges, such as cartridges with compressed carbon dioxide ($CO_2$) or other compressed gases.

The flight of the projectile 114 may be stabilized using conventional methods. For example, the stabilization may be accomplished by a gyroscopic effect by rotating of the projectile 114 along rifling along the surface of the bore 105. Alternatively, mechanical stabilizers, such as stabilizing fins, may be mounted on the rear part of the projectile 114. Such fins may be attached to the annular wad 126 and open after the projectile 114 exits the barrel 102. Alternatively, the stabilizing fins can be placed on the outlet of the barrel 102 and moved from the barrel 102 by the projectile 114 after exiting the bore 105.

Figure 3:
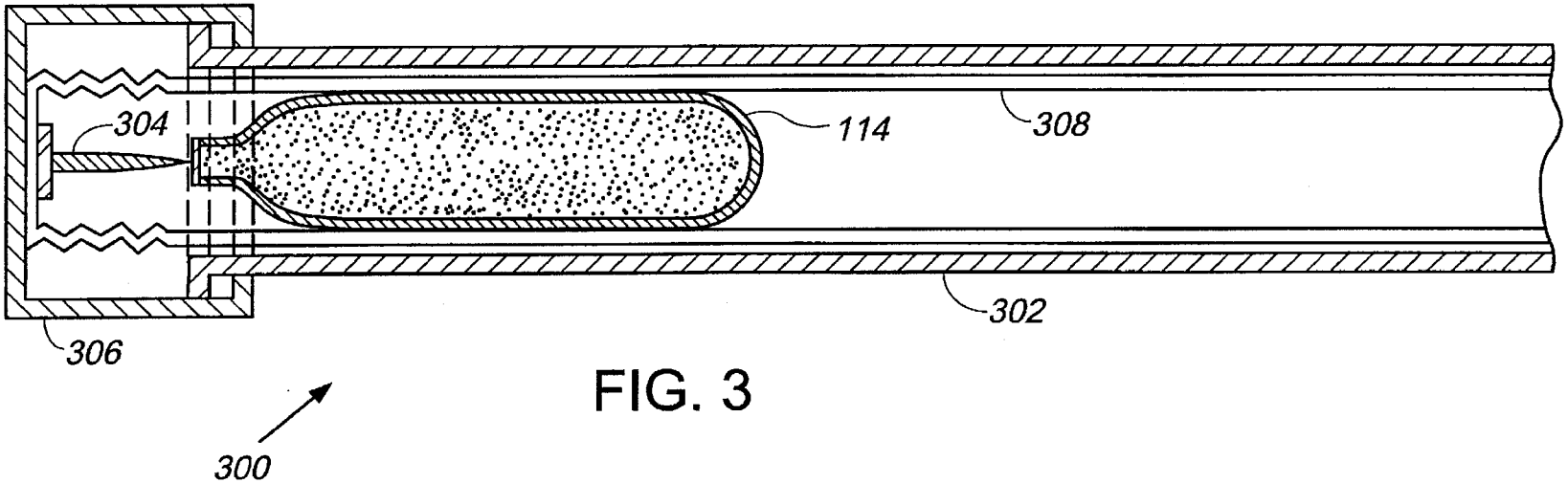
FIGS. 3 and 4 are longitudinal cross sectional views illustrating a loaded state and a state of shooting, respectively of another shooting system in accordance with the present invention.
Figure 4:
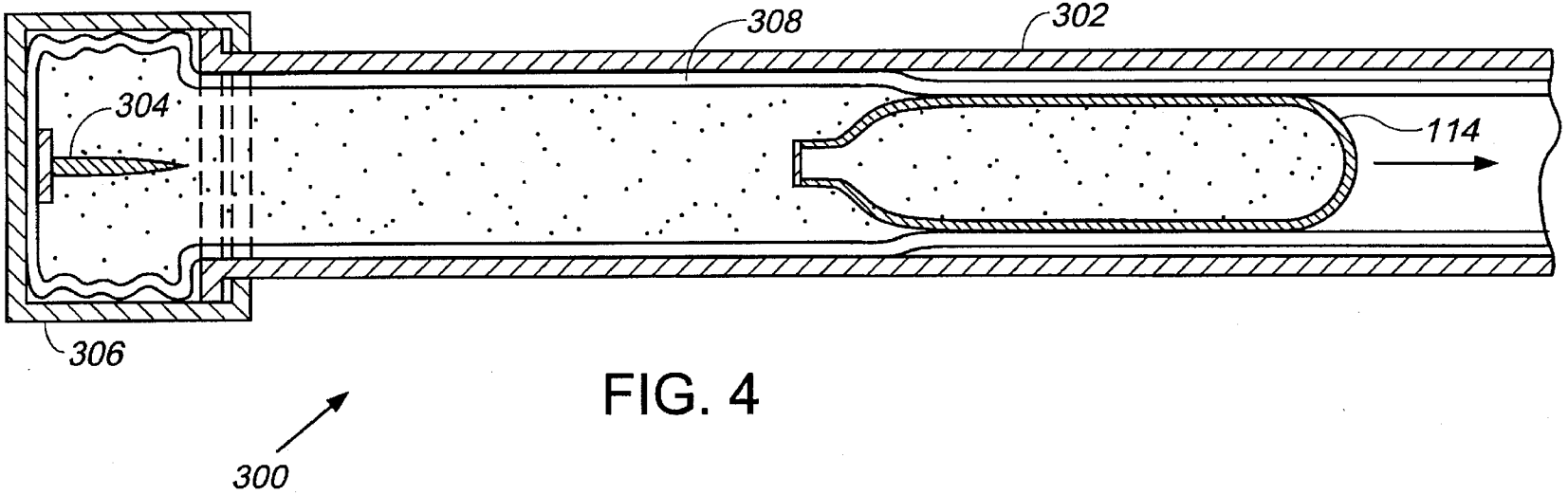

Referring to FIGS. 3 and 4, there are shown longitudinal cross-sectional views illustrating a loaded state and a shooting state, respectively, of a shooting system 300 in a second embodiment of the present invention. The shooting system 300 includes a barrel 302, a striker 304, an end cap 306, and inner tube 308. The shooting system 300 reduces the mechanical problem of precisely matching diameters of the barrel 302 which can be formed as a combination of a hard outer and elastic inner pipes. The diameter of the inner pipe allows to the projectile to be inserted therein with certain friction.

The end cap 306 is mounted to a rear end of the barrel 302. The inner dimensions of the end cap 306 may be larger than the outer dimensions of the barrel 302. The inner tube 308 has one end mounted to the inner wall of the end cap 306 and has an open end at the end of the barrel 302 opposite the end cap 306. The inner tube 308 is disposed along the inner a channel for the projectile form a channel for the projectile 114 as it moves through the barrel 302. The inner tube 308 forms a hermetic seal with the projectile 114.

The striker 304 is disposed in the end cap 306 and in a back crimped end of the inner tube 308 to open the valve 122 of the projectile 114. After the striker 304 pierces the membrane and the gases expire from the projectile 114 hermetization is achieved between the projectile 114 and the barrel 302 even without special wad and without difficult requirements of precise dimensions. While the inner elastic tube 308 ensures hermetization, the outer rigid barrel 302 limits expansion of the inner tube 308 as shown in FIG. 4. These functions can be combined into an integral barrel with the properties of limited expansion. The resulting device, having a simple construction, can be called a "disposable gun". In such a device, the barrel 302 may be formed of plastic, such as polyvinyl chloride and the tube 308 may be formed of a rubber material. The "disposable gun" may be simple and inexpensive, such as the shooting system of FIGS. 5–7.

Figure 5:
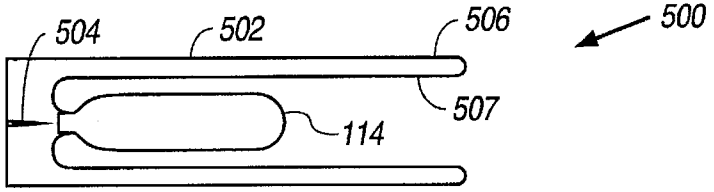
FIGS. 5, 6, and 7 are longitudinal cross-sectional views illustrating a loaded state, and first and second shooting states, respectively, of a shooting system in a third embodiment of the present invention.
Figure 6:
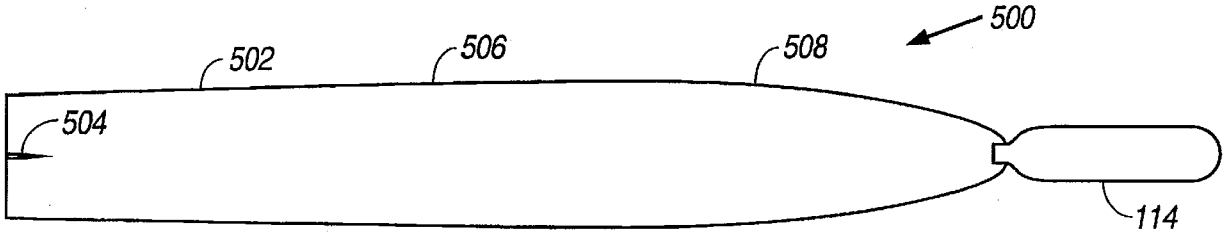
Figure 7:
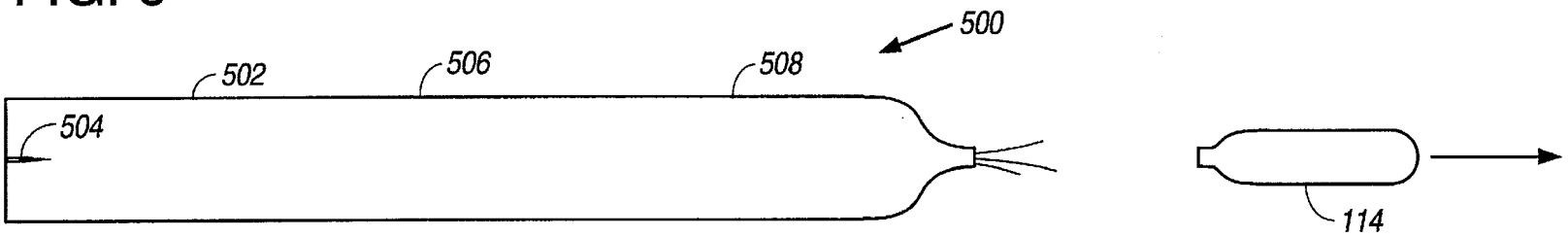

Referring to FIGS. 5, 6, and 7, there are shown longitudinal cross-sectional views illustrating a loaded state, and first and second shooting states, respectively, of a shooting system 500 in a third embodiment of the present invention. The shooting system 500 includes a barrel 502 and a striker 104. The barrel 502 includes a semi-rigid portion 506 and a flexible portion 508 having a first end mounted to a front end of the semi-rigid portion 506. The semi-rigid portion 506 and the flexible portion 508 may be formed of the same material and the rigidity or flexibility of such portions may be determined by the thickness of the wall of the portions, by the addition of ribs, or the like. The rear part of the barrel 502 may be crimped in a manner similar to that of the system 300 of FIGS. 3–4. The flexible portion 508 initially is in a bore of the semi-rigid portion 506.

The projectile 114 engages a second end of the flexible portion 508 with the valve 122 of the projectile 114 positioned near the striker 104 for engaging the striker 104 after actuation of the striker 104. The projectile 114 forms a hermetic seal between the projectile 114 and the second end of the flexible portion 508 of the barrel 502 to substantially contain the released fluid in the chamber until the projectile 114 disengages from the flexible portion 508. After the valve 122 is opened, the expanding gas urges the projectile 114 and the flexible portion 508 along the longitudinal axis of the barrel 502 to fully extend the flexible portion 508 as shown in FIG. 6. Referring now to FIG. 7, after the projectile 114 disengages from the flexible portion 508, the motion of the projectile 114 is due to inertia.

Figure 8A:
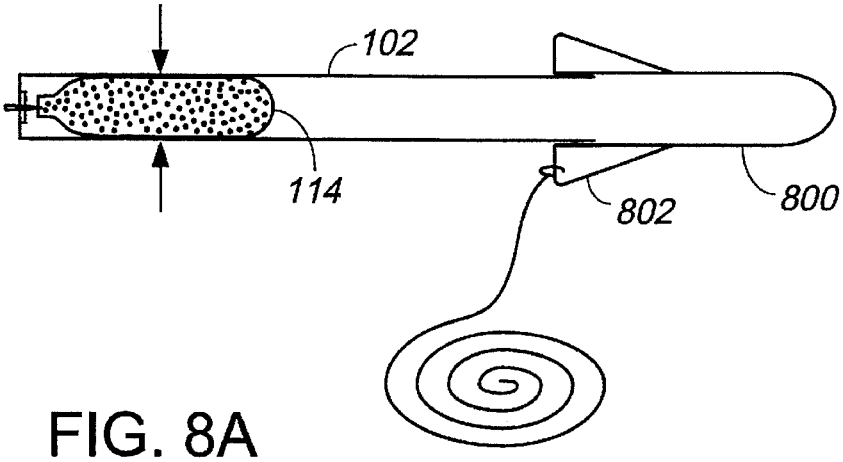
FIGS. 8*a*, 8*b*, and 8*c* are longitudinal cross-sectional views illustrating a shooting system for moving a load.
Figure 8B:
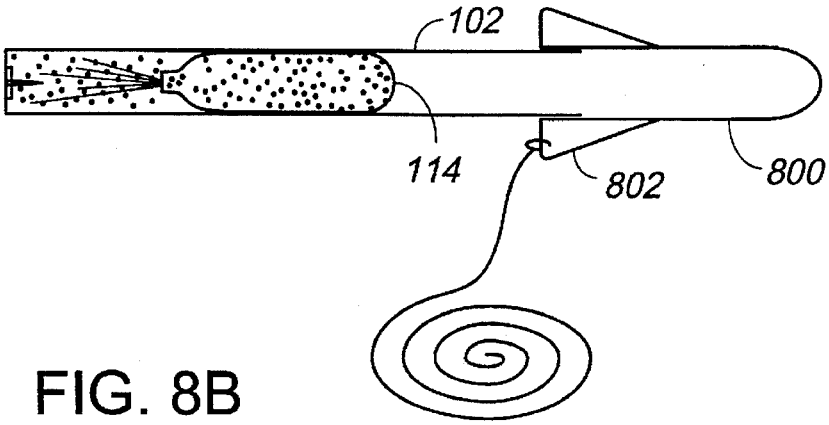
Figure 8C:
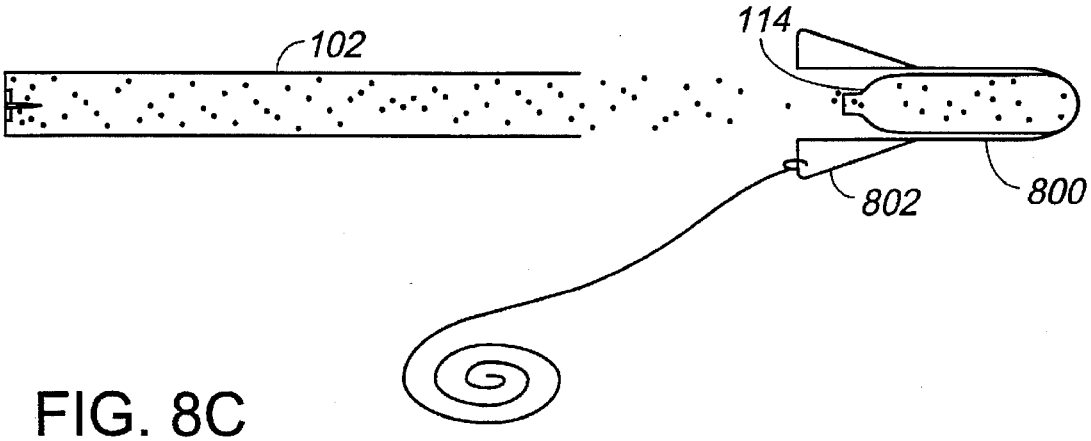

Referring to FIGS. 8*a*, 8*b*, and 8*c*, there are shown longitudinal cross-sectional views illustrating the shooting system 100 used for moving a load 800. The load 800 is detachably mounted to the front end of the barrel 102. The load 800 may include a plurality of stabilizers 802. The projectile 114 may carry the load 800, which may be, for example, an attached rope, a soft or sharp head, a device for producing sound, and the like. In addition, the method and the system of the present invention may be used in rescue operations by delivering ropes or flotation devices, or for extracting objects in an emergency, such as parachutes. Other uses include personal protection against attackers, riot rifles, or rifles for temporary immobilizing animals. A simple and inexpensive disposable gun may be used as a part of standard equipment for law enforcement personnel.

I claim:

1. A shooting system for shooting a projectile, the projectile for storing a compressible fluid in a compressed state and having a valve mounted in a rear end of the projectile, the shooting system comprising:

a longitudinal barrel having an opening on a front end and a cap on a rear end, the projectile being movable within the barrel;

a striker disposed in the cap for opening the valve of the projectile to release said fluid into a chamber to urge the projectile toward the opening of the barrel as the fluid is released, the rear end of the projectile, the barrel, and the cap forming the chamber;

the barrel further comprising a flexible inner tube disposed along an inner wall of the barrel engaging the projectile to form the chamber, the inner tube expanding to engage the inner wall of the barrel during said release of the fluid.

2. The shooting system of claim 1 wherein the projectile forms a hermetic seal between the projectile and the flexible inner tube to substantially contain the released fluid in the chamber until the projectile exits the opening of the barrel.

3. The shooting system of claim 1, wherein the barrel and the striker are formed of a disposable material.

4. A shooting system for shooting a projectile, the projectile for storing a compressible fluid in a compressed state and having a valve mounted in a rear end of the projectile, the shooting system comprising:

a longitudinal barrel having an opening on a front end and a cap on a rear end, the projectile being movable within the barrel;

a striker disposed in the cap for opening the valve of the projectile to release said fluid into a chamber to urge the projectile toward the opening of the barrel as the fluid is released, the rear end of the projectile, the barrel, and the cap forming the chamber;

the barrel further comprises a semi-rigid portion and a flexible portion, the-flexible portion having a first end mounted to a front end of the semi-rigid portion and having a second end for engaging the projectile near an end adjacent the valve, the flexible portion being capable of being inserted into the barrel to position the valve of the projectile near the striker.

5. The shooting system of claim 4 wherein the projectile forms a hermetic seal between the projectile and the second end of the flexible portion of the barrel to substantially contain the released fluid in the chamber until the projectile exits the opening of the barrel, and extends and disengages from the flexible portion.

6. The shooting system of claim 4 wherein the barrel and the striker are formed of a disposable material.

* * * * *